United States Patent [19]

Altherr et al.

[11] 4,172,530

[45] Oct. 30, 1979

[54] ROLL-OVER LOCK PROTECTION FOR RAILROAD CAR COUPLER

[75] Inventors: Russell G. Altherr, Munster, Ind.; John W. Kaim, Chicago, Ill.

[73] Assignee: Amsted Industries Incorporated, Chicago, Ill.

[21] Appl. No.: 894,700

[22] Filed: Apr. 10, 1978

[51] Int. Cl.[2] ..... B61G 3/00

[52] U.S. Cl. ..... 213/148; 213/122; 213/136

[58] Field of Search ..... 213/146, 148, 122, 136, 213/100, 77, 25 R, 158, 156, 62 R; 214/52 C

[56] References Cited

U.S. PATENT DOCUMENTS

| | | | |
|---|---|---|---|
| 1,612,775 | 12/1926 | Kelso | 213/127 |
| 3,258,132 | 6/1966 | Metzger et al. | 213/100 W |
| 3,433,369 | 3/1969 | Metzger et al. | 213/148 |

*Primary Examiner*—Trygve M. Blix
*Assistant Examiner*—Frank F. Atwood
*Attorney, Agent, or Firm*—John L. Schmitt; Fred P. Kostka; Edward J. Brosius

[57] ABSTRACT

A pair of elongated latches positioned transversely to a longitudinal axis of a railroad car particularly adapted to be rotated to an upside down position for gravity release of contents within the car, are pivotally attached respectively on each side of a top of a coupler lock. The coupler lock is an operative part of a coupler for the railroad car. The lock is movable within a lock chamber formed in a head of the coupler and is defined in part by vertical sidewalls and a roof or top wall. A configuration of each latch and relative position to the lock chamber sidewalls is such that a center of gravity of each latch lies above its pivot connection which insures that regardless of the direction of rotation of the car, at least one of the latches readily swings to an extended position to engage the top wall of the lock chamber and thereby prevent an inadvertent release of the lock when the car and at least one pair of mated couplers are rotated toward an inverted position for emptying contents of the car.

8 Claims, 10 Drawing Figures

FIG. 8
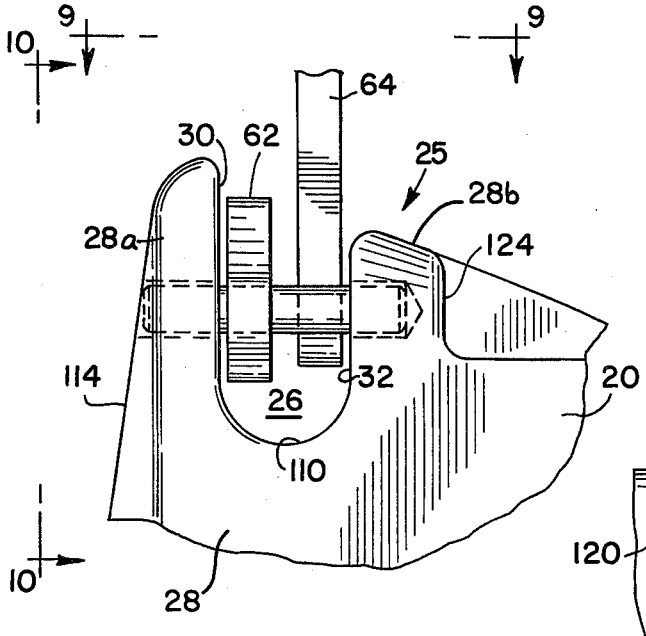
FIG. 9
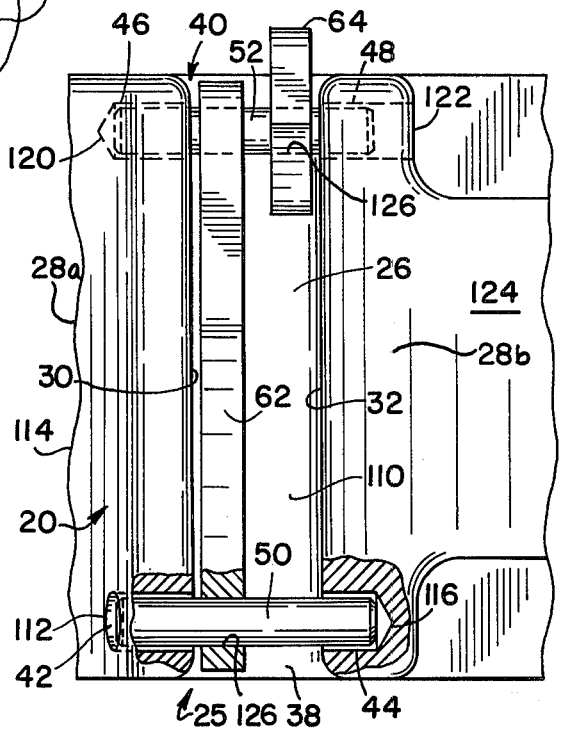
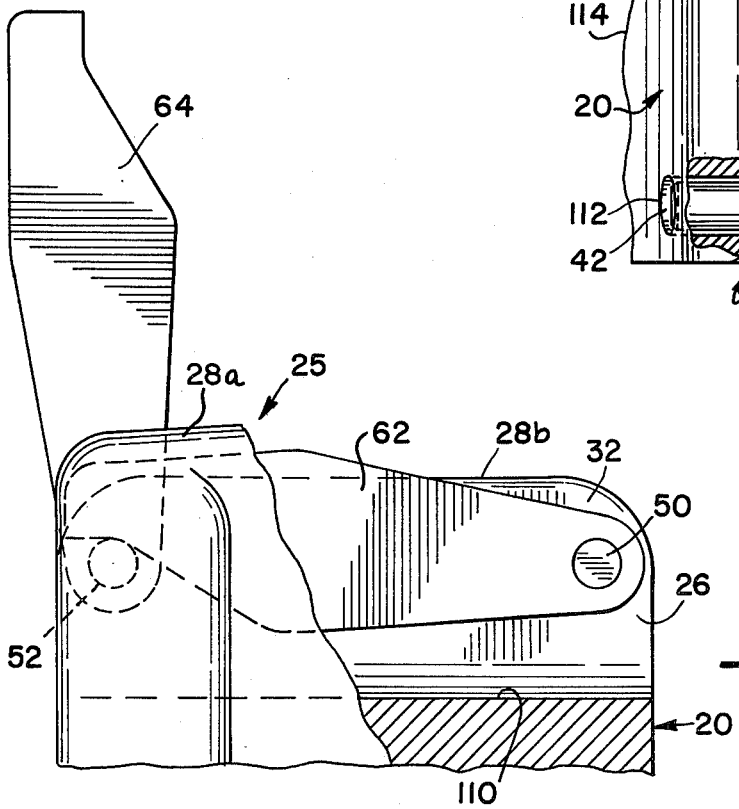
FIG. 10

ROLL-OVER LOCK PROTECTION FOR RAILROAD CAR COUPLER

BACKGROUND OF THE INVENTION

1. Field of the Invention

This invention relates to railroad car couplers and particularly to couplers used on railroad freight cars that remain coupled while the car is rotated or inverted to an upside down position to dump the car contents.

2. Prior Art

To facilitate rapid sequential emptying of hopper and gondola type railroad freight cars carrying such bulk commodities as coal, each car is provided with a front rotary type coupler, for example. The front rotary coupler is mated to a rear fixed type coupler of a car forward thereto while a rear fixed coupler is mated to a front rotary type coupler of a car to the rear thereof.

Upon a particular car entering a dump or unload station, the car is rotated toward an upside down position to produce a gravity release of its contents. During this movement, the car rotates about its front rotary coupler while the opposite or rear fixed coupler rotates with the car.

Under these operating conditions, Association of American Railroad (AAR) Type E or Type F couplers should not uncouple when so rotated. However, couplers have been known to uncouple during this rotation.

To prevent such an inadvertent release of the couplers, various devices have been incorporated as part of the coupler and particularly as part of a lock within a head of the coupler. The function of such a device is to limit movement of the lock when the coupler has been inverted to an extent that a knuckle of the coupler remains locked. When the coupler is in an upright position, the device allows normal coupler operation.

One such device is disclosed in U.S. Pat. No. 1,612,775 for use with the now obsolete Type D coupler.

Another anti-unlocking device for use with the now standard (AAR) Type F coupler is disclosed in U.S. Pat. No. 3,433,369.

SUMMARY OF THE INVENTION

Railroad car coupler utilizing an AAR standard coupler head has a vertical lock chamber in which a lock may be moved from a lower locked position to an upper unlocked position by manual manipulation through a lock lift assembly.

Within a top portion of the lock is an elongated slot defined in part by spaced vertical sidewalls. The slot is positioned transversely to a longitudinal axis of the railroad car.

In each end of the slot are aligned holes which receive a pivot pin positioned parallel to the longitudinal axis of the car. Each pivot pin, in turn, serves as an axis of rotation for one of two latches. One end of each latch is pivotably attached to one pin, respectively, while the other pin serves as a support of an opposite free end of the latch, respectively.

This pivot arrangement allows one latch to swing outwardly counterclockwise from one end of the slot and the other latch to swing outwardly clockwise from the other end of the slot and engage with sidewalls of the lock chamber. The latch is of such a configuration that angular movement of its center of gravity is limited to less than 90 degrees such that its initial swing action is enhanced and the limited angular movement insures a desired performance.

Upon rotation of the car during a dumping procedure, at least one latch will swing outwardly from the slot as the car approaches 90 degree rotation point. Beyond the 90 degree rotation point, the second latch will begin its swing with both latches extending downwardly when the car has rotated to an inclined position proximating 160 to 165 degrees for dumping. Certain unload stations rotate the car a full 180 degrees. A length of each latch is such that its free end rests adjacent the roof of the lock chamber to limit downward movement of the lock toward the roof of the lock chamber and to the unlocked position if such should occur.

It should be noted that two couplers are in fact rotated during this dumping procedure, i.e. a rear fixed coupler of the car being rotated and the front rotary coupler of the adjacent car to the rear.

There are several important advantages of this invention over prior art devices.

Firstly, by positioning the latches perpendicular to and the latch pivot axis parallel to the longitudinal axis of the car and the axis of rotation during the dumping procedure, a moment of force created by gravity on the latch is maximized. By maximizing this force, reliability of latch operation is improved.

A second important advantage of this invention is that reliability of the protection afforded is not affected by the direction of rotation of the car. The car may be rotated clockwise or counterclockwise to an inverted position and equal protection results because of the symmetry of the pivot placements.

Another important advantage is that at least one latch will be fully extended to prevent lock movement as the car approaches the 90 degree rotation point from upright or from an upside down position. Since at this point in the rotation of the car the force of gravity on the lock has only a negligible effect on lock movement, lock movement may occur. Having one latch fully extended insures that if such movement does occur, the movement is so limited that the lock does not reach an unlocked position.

DESCRIPTION OF THE DRAWINGS

FIG. 8 is a fragmentary elevational end view of a standard type railroad coupler lock with a second embodiment of the roll-over lock protection of this invention.

FIG. 9 is a top plan view of the lock of FIG. 8 taken generally along the line 9—9 of FIG. 8.

FIG. 10 is a cross-sectional front view of the lock of FIG. 8 taken generally along the line 10—10 of FIG. 8.

DESCRIPTION OF THE PREFERRED EMBODIMENT

Figure 1:
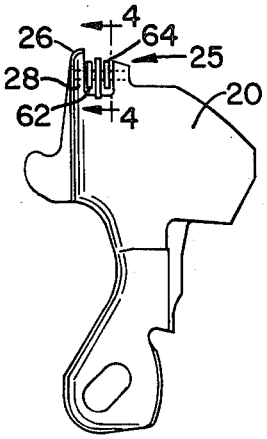
FIG. 1 is a side elevational view of a lock used in a standard type railroad car coupler with lock latches of this invention in a normal position.

A head of a standard type coupler is shown generally and designated 10. It should be understood that the coupler head 10 is carried at an outer end of a shank portion of the coupler while an inner end of the shank portion may be rotatively carried by a yoke to provide a rotary type coupler or pivotally carried by the yoke to provide a fixed type coupler.

The coupler head 10 further includes a lock chamber 12 defined by spaced sidewalls 14 and 16 and a roof or top wall 18. Within the lock chamber 12 is a coupler lock 20 which is movable from a lower locked position to a raised unlocked position by a lock lift assembly 22.

In the locked position, the lock 20 prevents rotation of a coupler knuckle 24 pivotally carried by the coupler head 10 so that the coupler may be selectively joined to a coupler of another railroad car; in the raised unlocked position, the lock 20 allows rotation of the coupler knuckle 24 and thus a release from a joined coupler condition.

As was noted earlier, a railroad car particularly adapted to be rotated to an inverted position to allow a gravity release of its contents is equipped with one fixed type coupler and one rotary type coupler carried at an opposite end of the car, respectively. The actual front or rear position of the particular type coupler is unimportant as long as all railroad cars joined to form a unit are similarly orientated, i.e. rotary coupler front, fixed coupler rear. With each car similarly oriented, a rotary couple of one car is coupled to a fixed couple of an adjacent car. This orientation allows an individul car to be inverted while cars coupled front and rear remain in an upright or normal position.

Figure 6:
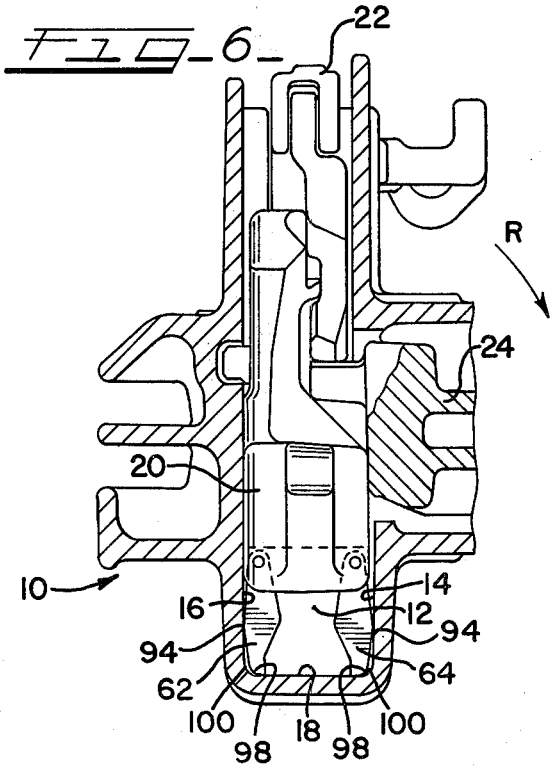
FIG. 6 is a cross-sectional elevational view through the standard type coupler head of FIG. 5 which has been rotated on an upside down position.

Under normal conditions, the lock lift assembly 22 in combination with the knuckle 24 and head 10 prevents movement of the coupler lock 20 when the coupler head 10 has been rotated to an upside down position (see FIG. 6). Because of wear, physical damage to the coupler head 10 or other uncontrollable mechanical problems, however, there exists a possibility of movement of the coupler lock 20 during such rotation, and if sufficient, could result in a release of the coupler knuckle 24 to allow an uncoupling from a connected car.

To insure that there is no movement of the coupler lock 20 during rotation of the coupler head 10, a lock protection means 25 is provided and includes an elongated slot 26 positioned transversely to a longitudinal axis of the railroad car and formed in a top front portion 28 of the coupler lock 20. The slot 26 is thus perpendicular to the axis of rotation of the coupler head 10 and is defined by spaced vertical sidewalls 30, 32 and a flat bottom 34 containing a centrally located elongated groove 36.

Figure 2:
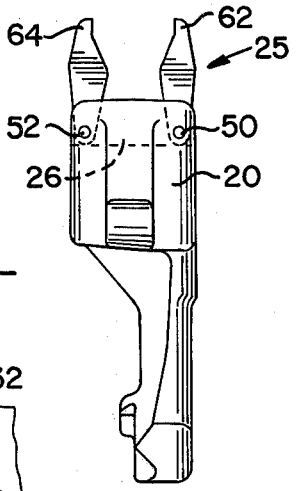
FIG. 2 is a front elevational view of the coupler lock of FIG. 1 with its lock latches in a fully extended position.
Figure 7:
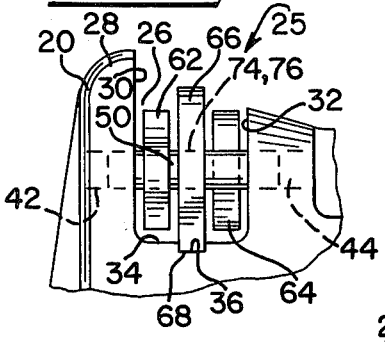
FIG. 7 is a fragmentary elevational end view of the coupler lock of FIG. 3 taken generally along the line 7—7 of FIG. 3.
Figure 3:
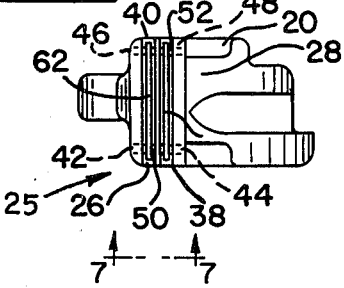
FIG. 3 is a top view of the lock of FIG. 1.
Figure 4:
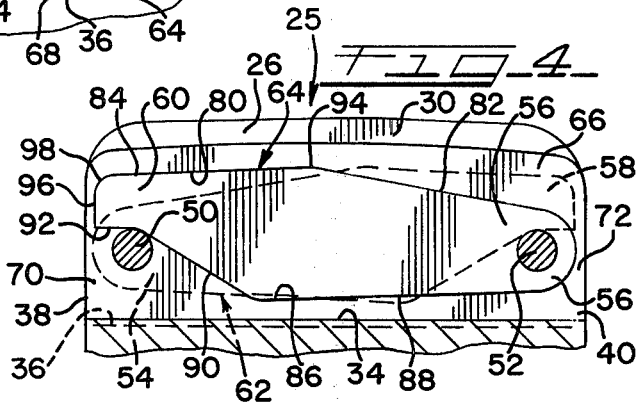
FIG. 4 is a cross-sectional elevational view taken generally along the line 4—4 of FIG. 1.

Near each end 38, 40 of the slot 26 in the sidewalls 30, 32 are laterally positioned apertures 42, 44 and 46, 48 to receive pins 50, 52 respectively. Pins 50, 52 may be of a spring type such that there is a compression fit between the pin 50 and the apertures 42, 44 and between the pin 52 and the apertures 46, 48. The pins 50, 52 each form a pivot for respective pivot ends 54, 56 and a support for free ends 58, 60 of a first and a second lock latch 62, 64. As seen in FIG. 2, the first lock latch 62 may rotate from the slot 26 clockwise about the pin 50 while the second lock latch 64 may rotate from the slot 26 counterclockwise about the pin 52. As seen in FIG. 4, the swing of each latch 62, 64 would be oppositely defined.

As best seen in FIG. 6, each latch 62, 64 has a length such that it may rotate proximately, but less than 90 degrees until it contacts sidewalls 14, 16 respectively without engaging the roof 18 of the lock chamber 12, and subsequently, one latch will contact the roof 18 upon a slight downward movement of the coupler lock 20. Such downward movement is less than that which would result in the lock 20 assuming an unlocked position.

Separating the first and the second latches 62, 64 is a spacer 66 having a bottom edge 68 disposed in the groove 36 of the slot 26 and its ends 70, 72 retained by the pins 50, 52 respectively, inserted through apertures 74, 76 formed in the spacer 66.

The latches 62, 64 have like configurations and therefore only one latch, for example the latch 64, will be described in detail. The latch 64 has a flat elongated body defined by a top edge 80 divided into a pivot end portion 82 and a free end portion 84. A bottom edge 86 of the latch 64 is likewise divided into a pivot end portion 88 and a free end 90 having a flat end segment 92 for engaging and resting on the pin 50 when the coupler head 10 is in a normal or upright position. The top edge portions 82, 84 are angularly inclined to form a contact point 94 at an intersection of such. An end wall 96 of the free end 60 of the latch 64 joins top edge free end portion 84 to form a radius 98 to complementarily conform with a radius 100 formed between the sidewalls 14, 16 and the roof 18 of the lock chamber 12.

Because of the configuration of the latches 64 and the position of the pins 50, 52, the angular movement of the center of gravity of the latch 64 is less than 90 degrees during movement between a normal position (FIG. 5) and a fully extended position (FIG. 6). In the normal position, the center of gravity of the latch lies above a line joining centers of pins 50 and 52. Likewise, the center of gravity of the latch 64 in a fully extended position lies between the centers of the pins 50, 52. Having an offset center of gravity in each position assures initial latch movement from a closed or open position.

Figure 5:
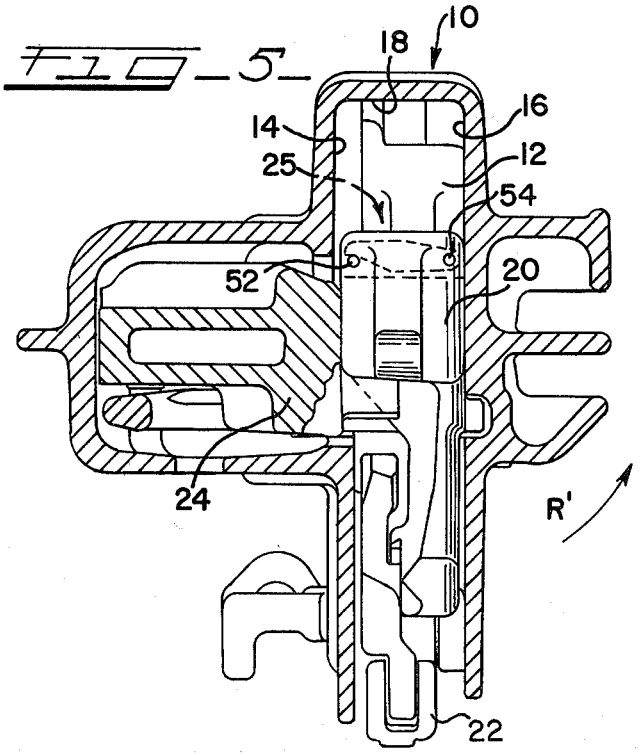
FIG. 5 is a cross-sectional front elevational view through a standard type railroad car coupler head in a normal or upright position incorporating the roll-over latch protection arrangement of this invention.

In normal operation, the coupler head 10 is in an upright position as seen in FIG. 5 with the lock lift assembly 22 and the lock 20 maintaining the knuckle 24 in a fixed position to prevent any disengagement from an attached coupler of an adjacent railroad car coupler. The latches 62, 64 as seen in FIG. 5, are within the slot 26 and separated by the spacer 66.

During an unloading of the railroad car, the body of the car and at least two couplers are rotated sufficiently to dump the contents of the car. This rotation may be for a full 180 degrees to an upside down position as seen in FIG. 6. The direction of rotation may be clockwise or counterclockwise depending upon the particular configuration of the dumping station.

Assuming a clockwise rotational direction as depicted by an arrow R of FIG. 6, as the rotation approaches the 90 degree point, the first latch 62 rotates from its position within the slot 26 to a position of full extension with the contact point 94 of the latch 62 engaged against the sidewall 16 of the lock chamber 12. Rotation of the first latch 62 occurs as the coupler head 10 approaches the 90 degree rotation point because the center of gravity of the latch 62 is offset as described earlier.

As rotation of the railroad car and related couplers continues past the 90 degree point, the second latch 64, under the influence of gravity, releases from the slot 26 and becomes fully extended if the car is rotated a full 180 degrees.

It should be understood that the sequence of latch release is reversed if the railroad car is rotated counterclockwise.

As the railroad car is righted after dumping as depicted by an arrow R' in FIG. 5, assuming a reverse or counterclockwise rotation, the second latch 64, under the influence of gravity, will rotate clockwise to return to the slot 26 as the car returns to the 90 degree rotational point. As the car approaches an upright position, the first latch 62, under the force of gravity, returns to the slot 26. Note that when the latches 62, 64 are fully extended, engagement of the contact point 94 of each latch 62, 64 with the sidewalls 14, 16 keeps each latch 62, 64 in a slightly inwardly inclined position such that the center of gravity of each latch 62, 64 remains inwardly offset to provide a releasing force on the first released latch, and in the example, the latch 62.

During the swing of the latches 62, 64 from the slot 26 to a fully extended position and then return to the slot 26, the spacer 66 assures that a plane of rotation of each latch 62, 64 remains separated thus preventing one latch from striking the other latch and interfering with the movement thereof.

As best understood by viewing FIGS. 8, 9 and 10 is a second embodiment of the lock protection means 25 of this invention. Reference numbers identifying similar structure in this second embodiment as in the first embodiment are used where applicable.

This lock protection means 25 is formed as part of the front top portion 28 of the coupler lock 20 and likewise includes the elongated slot 26 positioned transversely to the longitudinal axis of the railroad car. The slot 26 is defined by spaced vertical sidewalls 30, 32 and a rounded bottom 110 joining the sidewalls 30, 32.

Near each of the ends 38, 40 of the slot 26 in the sidewalls 30, 32 are the laterally positioned and aligned apertures 42, 44 and 46, 48. The aperture 42 extends through a front part **28*a* of the top portion 28 to form an opening 112 in a front face 114 of the front part 28*a* while the aperture 44 is formed with a closed end 116. The aperture 46 is formed with a closed end 120 while the aperture 48 extends through a rear part 28*b* of the top portion 28 to form an opening 122 in a rear face 124 of the rear part 28*b*. The diameter of the pins 50, 52 provides a loose fit with the apertures 42, 44 and 46, 48 respectively. An aperture 126 formed in the pivot ends 54, 56 of the first and second latches 62, 64 provides a compression fit between the pins 50, 52** and the first and second latches respectively and therefore prohibits movement from its predetermined position along the axis of the pin.

During rotation of the first latch 62, for example, lateral movement of the latch 62 is limited by contact between the latch 62 and the slot sidewall 30 and the pin 50 with the end 116 of aperture 44. Thus a plane of rotation of each latch 62, 64 remains separated to prevent one latch from striking the other latch and interfering with the rotational movement thereof.

While various modifications may be suggested by those versed in the art, it should be understood that we wish to embody within the scope of the patent warranted hereon, all such modifications as reasonably and properly come within the scope of our contribution to the art.

What is claimed is:

1. A latching device to prevent an inadvertent uncoupling of coupled railroad cars during rotation of one said car to allow a gravity release of contents within said rotated car, said device comprising, a first latch means to selectively limit movement of a lock of said coupler, said first latch means pivotally attached to a side of said lock with said pivotal attachment having an axis positioned parallel to an axis of said car rotation and said first latch means having a center of gravity offset from said axis of said car rotation, and a second latch means to selectively limit movement of said lock of said coupler, said second latch means pivotally attached to an opposite side of said lock with said pivotal attachment having an axis positioned parallel to said axis of said car rotation and said second latch means having a center of gravity offset from said axis of said car rotation, wherein said car may be rotated clockwise or counterclockwise from a normal upright position to an unload upside down position with said first and said second latch means swinging from a position allowing a normal coupling-uncoupling operation of said coupler to a position preventing said normal coupling-uncoupling operation.

2. A latching device to prevent an inadvertent release of a lock of a railroad car coupler during rotation of said car to an upside down position to empty contents carried by said car, said device comprising, a coupler head, a coupler knuckle pivotally carried by said head to rotate between a coupled position and an uncoupled position, a coupler lock movably carried in a vertical lock chamber formed in said coupler head to regulate said knuckle position, a first latch means pivotally attached in an end of a laterally positioned slot formed in a top portion of said coupler lock, and a second latch means pivotally attached in an oposite end of said slot, wherein said first and said second latch means are carried in said slot when said car is in a normal position and swing outwardly upon said car being rotated to an upside down position to engage a roof of said lock chamber and limit a downward movement of said coupler lock.

3. A latching device as defined in claim 2 and further characterized by including, separating means carried in said slot between said first latch means and said second latch means to maintain said latch means in a separated relationship.

4. Roll-over lock protection device for use with a railroad car coupler having a coupler head pivotally supporting a coupler knuckle securable in a locked position by a lock carried within said coupler head, said lock protection device comprising, an elongated horizontal receiving area formed in an upper portion of said lock and positioned laterally to a longitudinal axis of said coupler, a first latch means pivotally attached at one end of said receiving area, and a second latch means pivotally attached at an opposite end of said receiving area, wherein said first and said second latch means may swing from a normal horizontal position to an extended vertical position upon rotation of said coupler from a normal position to a dump position to prevent said lock from inadvertent movement to an unlocked position in the coupler head.

5. A roll-over lock protection device as defined by claim 4 and further characterized by including, an elongated groove formed in a bottom of said receiving area, spacer means for separating said first and said second latch means, said spacer means having a bottom edge resting in said groove and ends retained by pins forming in part said pivot attachment for said first and said second latch means respectively, and said first and said second latch means each further comprising a flat elongated body defined by, a top edge divided into a top free end portion and a top pivot end portion, said portions intersecting to form a sidewall contact point to engage a sidewall of said coupler head upon said latch being rotated to an extended position and maintain said latch in a releaseable position, a bottom edge divided into a bottom free end portion having a flat end segment for engagement with said adjacent pivot pin, and a bottom pivot end portion with said top and said bottom pivot end portions converging toward said pivot pin end and said top and bottom free end portions converging toward said free end, and a center of gravity lying above a line joining centers of said pivotal attachments with said latch means in said horizontal position and between said center with said latch means in said vertical position, wherein at least one of said latches swings outwardly from said receiving area upon said coupler being rotated proximately, but less than, 90 degrees from said normal position toward said dump position, and said latches swing inwardly upon said coupler being rotated from said dump position to said normal position.

6. A roll-over lock protection device as defined by claim 4 and further characterized by, said receiving area being a slot formed having spaced sidewalls, a pair of aligned holes formed one each in said sidewalls near ends of said slot, one each of said pair of said holes having at least one closed end, said first and said second latch means each formed having an aperture in a pivot end of said latch with a pivot pin disposed one each in said pair of aligned holes with a loose fit and in said aperture of said latch means with a compression fit, respectively, wherein lateral movement of each said latch is limited by said closed end of said hole and said spaced side of said slot adjacent to said latch.

7. A roll-over lock protection device as defined by claim 6 and further characterized by, said first and said second latch means each further comprising a flat elongated body including, a top edge divided into a top free end portion and a top pivot end portion, said portions intersecting to form a sidewall contact point to engage a sidewall of said coupler head upon said latch body being rotated to said extended position and maintaining a center of gravity of said latch body between centers of said pivot pins, and a bottom edge having a flat end segment formed at a free end of said latch body for engagement with said adjacent pivot pin and positioning said latch body such that said center of gravity of said latch body lies above a line joining said centers of said pivot pins with said latch means in a horizontal position.

8. In a coupler including a head having a lock chamber defined by sidewalls and an upper wall and a lock movable within said lock chamber between a locked position and an unlocked position relative to a coupler knuckle, a latch arrangement for preventing inadvertent movement of said lock from said locked position comprising, slot means in said lock extending transversely to the longitudinal axis of said coupler and facing said chamber upper wall, a pair of latch plates disposed in said slot with each latch of said pair being mounted for pivotal movement at opposite ends of said slot so as to be gravity actuated during either clockwise and counterclockwise rotation of said coupler to an inverted position, wherein a free end of at least one of said latch plates is engageable with said chamber upper wall to thereby preclude movement of said lock toward said chamber upper wall and out of said locked position.

* * * * *